US006945665B2

(12) United States Patent
Hsien

(10) Patent No.: US 6,945,665 B2
(45) Date of Patent: Sep. 20, 2005

(54) CEILING LAMP JUNCTION BOX/LAMP ROD FOLDING INSTALLATION STRUCTURE

(76) Inventor: Pi-Hua Hsien, No. 18, Ping-Ho 10 Street, Lun-Ping Li, Changhua-City (TW)

( * ) Notice: Subject to any disclaimer, the term of this patent is extended or adjusted under 35 U.S.C. 154(b) by 0 days.

(21) Appl. No.: 10/690,596

(22) Filed: Oct. 23, 2003

(65) Prior Publication Data

US 2005/0088840 A1 Apr. 28, 2005

(51) Int. Cl.[7] ..... F21S 8/00

(52) U.S. Cl. ..... 362/147; 362/249; 362/406; 362/427; 362/640; 362/371

(58) Field of Search ..... 362/147, 148, 362/249, 405, 427, 226, 370, 371, 406; 248/343, 906

(56) References Cited

U.S. PATENT DOCUMENTS 1,031,241 A * 7/1912 Camp ..... 248/317

* cited by examiner

*Primary Examiner*—Sandra O'Shea
*Assistant Examiner*—Sharon Payne
(74) *Attorney, Agent, or Firm*—Dennison, Schultz, Dougherty & MacDonald

(57) ABSTRACT

A ceiling lamp junction box/lamp rod folding installation structure comprises a junction box and lamp rods hinged to the junction box. The junction box has a plurality of portals arrayed along its circumferential surface. Aligned with the portal a carrier mount having a reticulation prefabricated coupling section on each of its two ends, thereby providing for the insertion of a pin to movably dispose a swivel block and the insertion of a pin through the other end of the carrier mount to constitute a latch mechanism. The swivel block has a rack surface along one side, the notches of the rack surface provide for engagement with a side corner of a check block. As such, the lamp rods and the junction box in the hinged state provides for the turning of the lamp rods to reduce the space occupied during shipment.

4 Claims, 4 Drawing Sheets

CEILING LAMP JUNCTION BOX/LAMP ROD FOLDING INSTALLATION STRUCTURE

BACKGROUND OF THE INVENTION

1) Field of the Invention

The invention herein relates to lighting fixtures, specifically a ceiling lamp junction box/lamp rod folding installation structure in which aligned with the portal of the junction box is a carrier mount having a reticulation prefabricated at the center and a coupling section on each of its two ends, thereby providing for the insertion of a pin through one end of the carrier mount to movably dispose a swivel block and the insertion of a pin through the other end of the carrier mount to constitute a latch mechanism. The swivel block has a rack surface along one side, the notches of the said rack surface providing for engagement with a side corner of the check block. As such, the lamp rods and the junction box in the hinged state provides for the turning of the lamp rods, with the center of rotation at a certain pivot area, to adjust the angle of the lamp rods to the junction box and thereby bring the lamp rods into a horizontal arrangement to reduce the space occupied by the lamp rods and the junction box during shipment.

2) Description of the Prior Art

Lamps now in the highest demand are models of reduced dimensions that have lower shipping costs and, furthermore, provide for user safety and convenient assembly, with such features indispensable for raising market competitiveness. However, in order to prevent electrocution hazards, conventional products are typically delivered from the manufacturer with the light bulb sockets on the lamp rods pre-wired in advance, which significantly enlarges packaging dimensions and increases shipping costs. Furthermore, during user assembly and installation, since the light bulb sockets and the junction box are already wired, separation is not possible. As the light bulb sockets and the junction box are in a permanent arrangement such that the angle between the light bulb sockets and the junction box cannot be further adjusted, this also results in higher shipping expenditures.

To enable the examination committee a further understanding of the structure, features, capabilities, and practical objectives of the folding lamp rod and junction box structure for lamps herein, the brief description of the drawings below is followed by the detailed description of the invention herein.

BRIEF DESCRIPTION OF THE DRAWINGS

FIG. 3-B is a cross-sectional drawing of the invention herein in the engaged state.

DETAILED DESCRIPTION OF THE INVENTION

Figure 1:
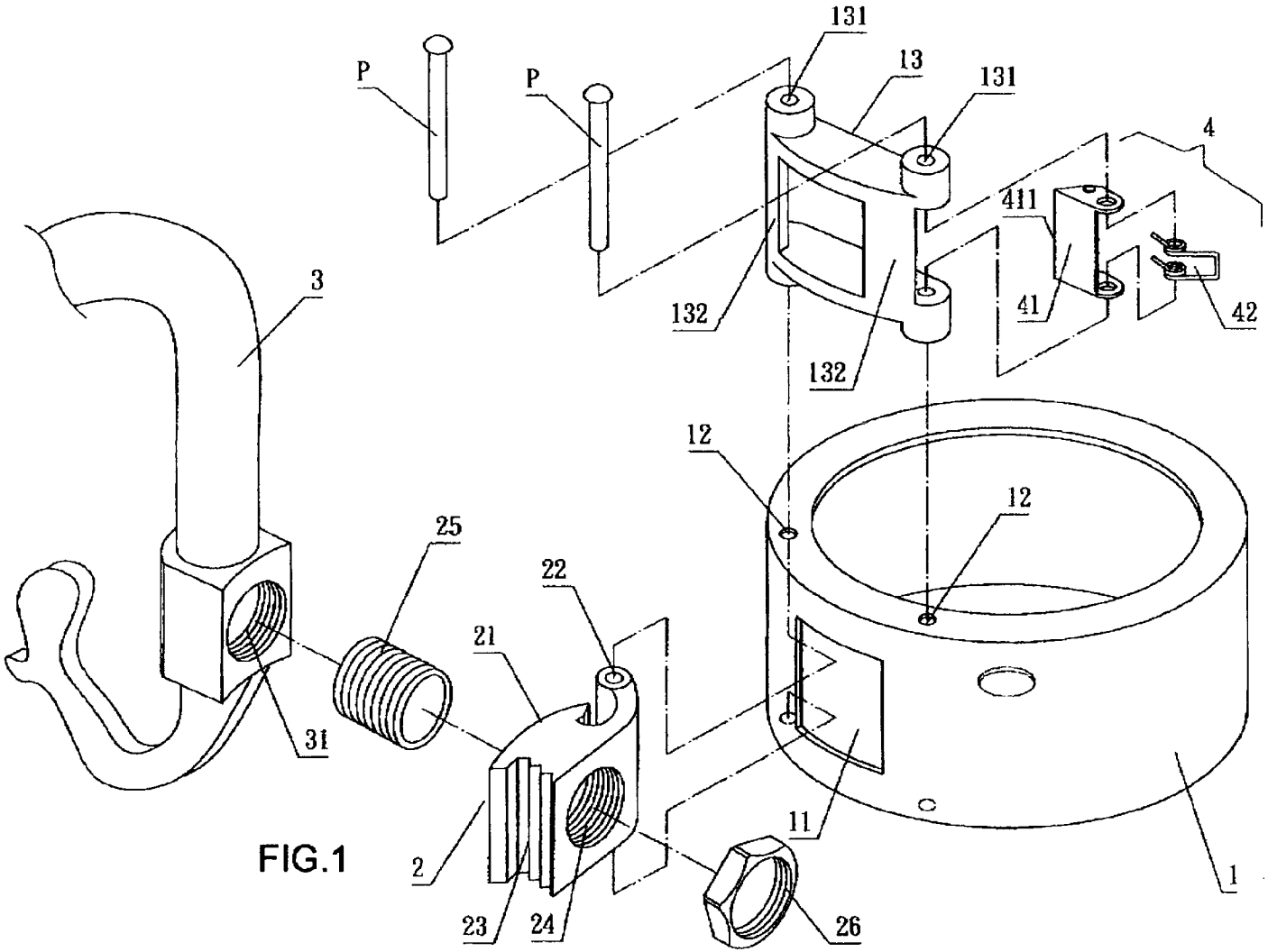
FIG. 1 is an exploded drawing of the invention herein.
Figure 2:
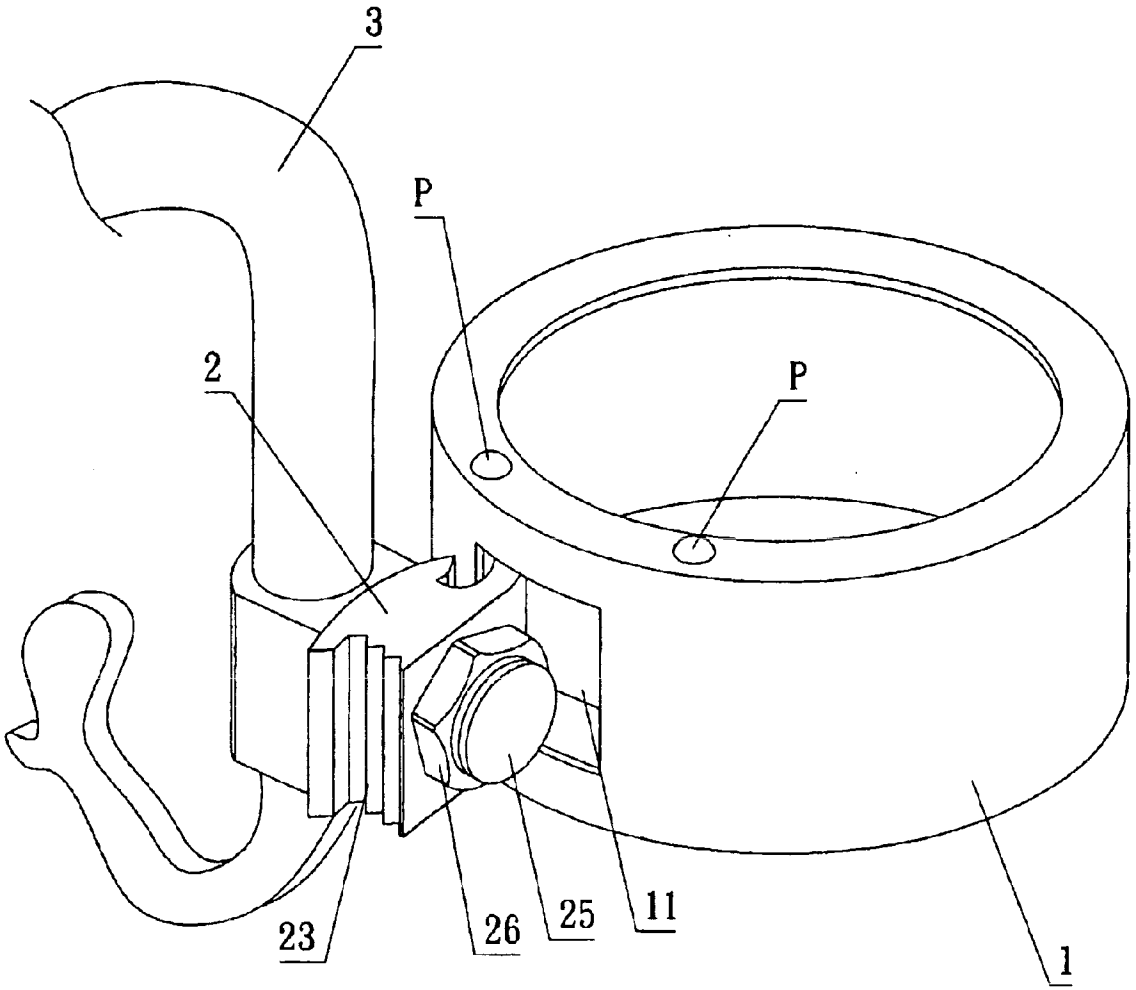
FIG. 2 is an isometric drawing of the invention herein.
Figure 3B:
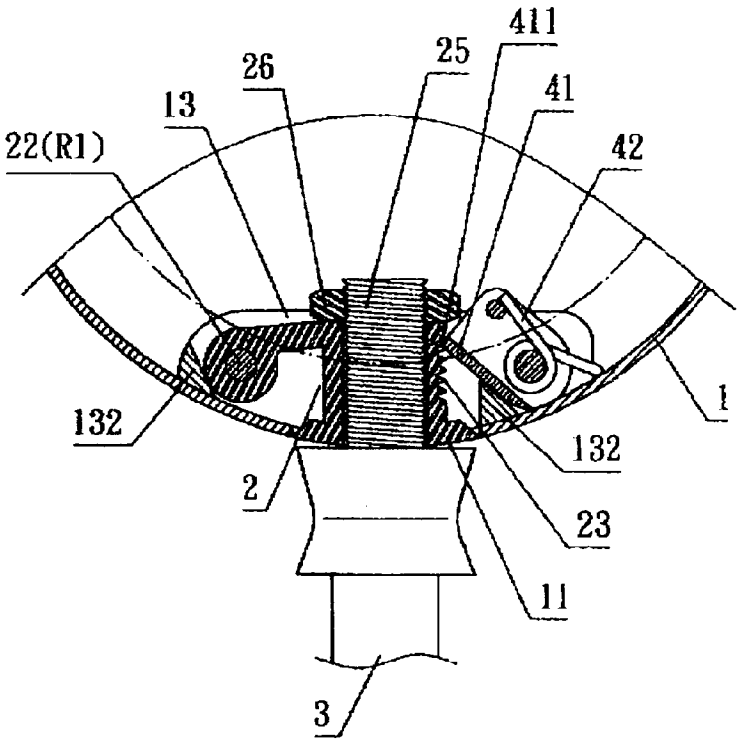
FIG. 3-A is a cross-sectional drawing of the invention herein before engagement.
Figure 3A:
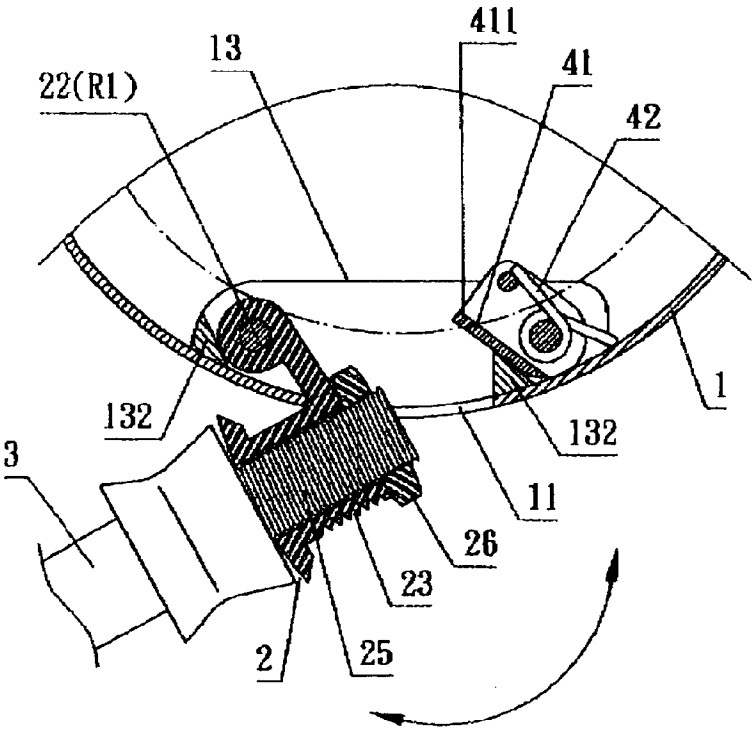

Referring to FIG. 1 and FIG. 2, the structural arrangement of the present invention, the invention herein is comprised of a swivel block 2 movably disposed in a portal 11 at the side of a junction box 1 and a lamp rod 3 fastened to the swivel block 2, wherein:

The said junction box 1 has a plurality of portals 11 appropriately arrayed along its circumferential surface and, furthermore, pivot holes 12 are formed in the top surface at the lateral edge of each portal 11 in the junction box 1; aligned with the pivot holes 12 on the portal 11 of the junction box 1 is a carrier mount 13 having a reticulation prefabricated at the center and a coupling section 131 on each of its two ends, thereby providing for the insertion of a pin P through one end of the carrier mount 13 to movably dispose a swivel block 2 and the insertion of a pin P through the other end of the carrier mount 13 to constitute a latch mechanism 4; the carrier mount 13 also has a hitch rod 132 disposed against the inner edge of the junction box 1 at the two ends of the portal 11, and a hitch rod 132 is situated at the same side of the latch mechanism 4 to provide for the positional engagement of the latch mechanism 4.

The said latch mechanism 4 consists of the pin P inserted through the carrier mount 13 coupling section 131 and then sequentially through a check block 41 and a torque spring 42 that keeps the two positioned at the carrier mount 13 front end, the supportive force of said check block 41 torque spring 42 causing its lateral edge to be propped against the carrier mount 13 hitch rod 132 and thereby positioning the torque spring 42 at the lateral edge of the carrier mount 13.

The said swivel block 2 circumferential surface 21 and the junction box 1 circumferential edge are congruent circle segments and, furthermore, a hinge rod 22 contoured at the side of the swivel block 2 extends into the junction box 1, and the said hinge rod 22 is aligned with the carrier mount 13 coupling section 131 and movably positioned thereon by the inserted pin P; the swivel block 2 has a rack surface 23 along one side, the notches of the said rack surface 23 providing for engagement with a side corner 411 of the check block 41; the swivel block 2 also has a through-hole 24 formed in its center and, furthermore, a threaded rod 25 is inserted into the through-hole 24, with one extremity of the threaded rod 25 fastened into a threaded hole 31 of the lamp rod 3 and the opposite extremity fastened into a nut 26 to thereby position the swivel block 2 on the lateral edge of the lamp rod 3.

Figure 4:
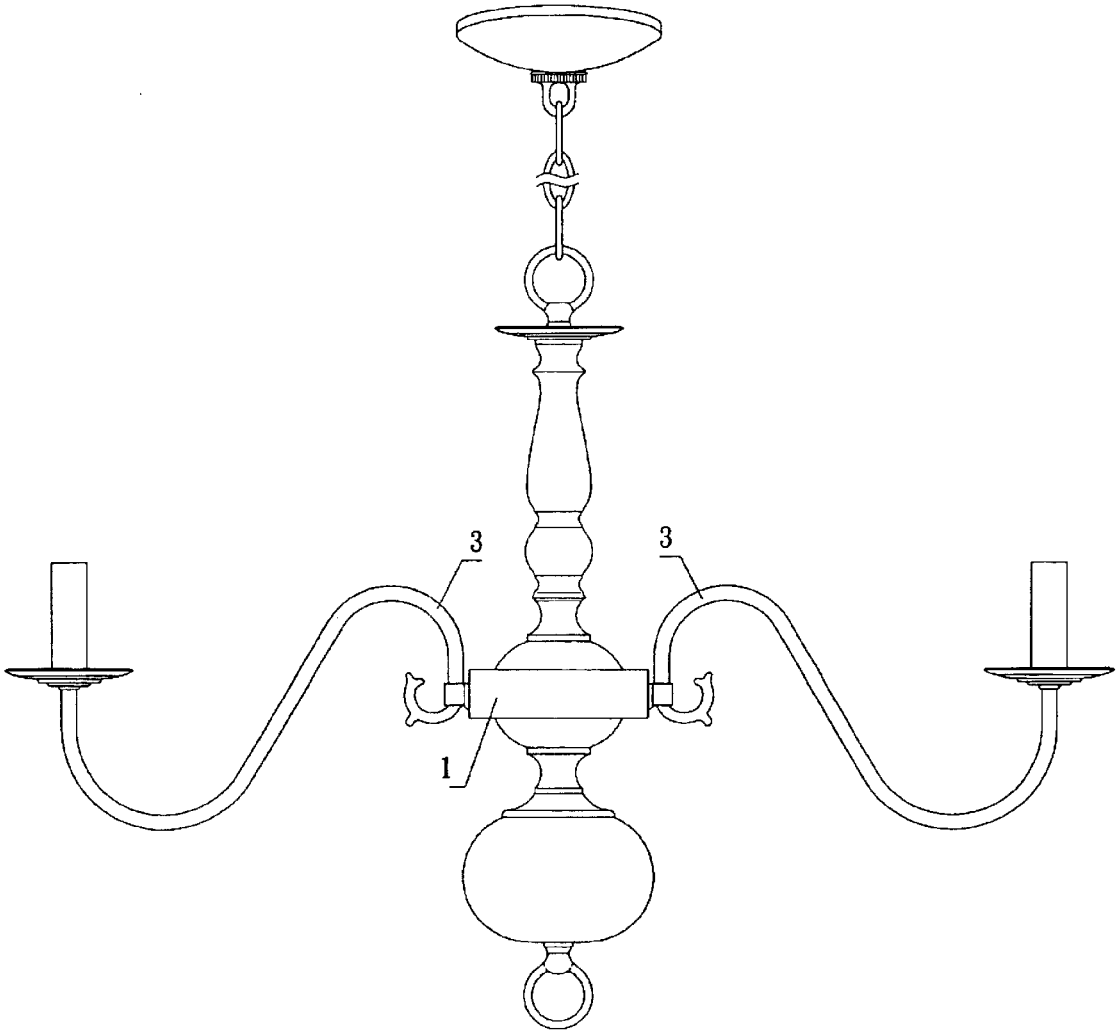
FIG. 4 is an orthographic drawing of the ceiling lamp embodiment of the invention herein.

Referring to FIG. 4, the lamp rods 3 and the junction box 1 in the hinged state provides for the turning of the lamp rods 3, with the center of rotation at the pivot area R1, to adjust the angle of the lamp rods 3 to the junction box 1 and thereby bring the lamp rods 3 into a horizontal arrangement to reduce the space occupied by the lamp rods 3 and the junction box 1 during shipment.

What is claimed is:

1. A ceiling lamp junction box/lamp rod folding installation structure comprised of a swivel block movably disposed in a portal at the side of a junction box and a lamp rod fastened to the said swivel block, wherein:

the said junction box has a plurality of portals appropriately arrayed along its circumferential surface and, furthermore, pivot holes are formed in the top surface at the lateral edge of each said portal in the said junction box; aligned with the said pivot holes on the said portal of the said junction box is a carrier mount having a reticulation prefabricated at the center and a coupling section on each of its two ends, thereby providing for the insertion of a pin through one end of the said carrier mount to movably dispose the said swivel block and the insertion of a pin through the other end of the said carrier mount to constitute a latch mechanism; the said carrier mount also has a hitch rod disposed against the inner edge of the said junction box at the two ends of the said portal, and said hitch rod is situated at the same side of the said latch mechanism to provide for the positional engagement of the said latch mechanism;

a hinge rod contoured at the side of the said swivel block extends into the said junction box, and the said hinge rod is aligned with the said carrier mount coupling section and the said swivel block is positioned on the lateral edge of the said lamp rod and, as such, provides for the turning of the lamp rod, with the center of rotation at a pivot area, to adjust the angle of the said lamp rods to the said junction box and thereby bring the said lamp rods into a horizontal arrangement to reduce the space occupied by the said lamp rods and the said junction box during shipment.

2. A ceiling lamp junction box/lamp rod folding installation structure as claimed in claim 1 in which the said swivel block circumferential surface and the said junction box circumferential edge are congruent circle segments and, furthermore, a state of confluence exists with the circumferential edge of the said junction box.

3. A ceiling lamp junction box/lamp rod folding installation structure as claimed in claim 1 in which the said latch mechanism consists of the said pin inserted through the said carrier mount coupling section and then sequentially through a check block and a torque spring that keeps the two positioned at the said carrier mount front end, the supportive force of said check block torque spring causing its lateral edge to be propped against the said carrier mount hitch rod and thereby positioning the said torque spring at the lateral edge of the said carrier mount.

4. A ceiling lamp junction box/lamp rod folding installation structure as claimed in claim 1 in which the said swivel block has a rack surface along one side, the notices of the said rack surface providing for engagement with a side corner of the said check block; the said swivel block also has a through-hole formed in its center and, furthermore, a threaded rod is inserted into the said through-hole, with one extremity of the said threaded rod fastened into a threaded hole of the said lamp rod and the opposite extremity fastened into a nut to thereby position the said swivel block on the lateral edge of the said lamp rod.

* * * * *